US007866391B2

(12) United States Patent
Wardley et al.

(10) Patent No.: US 7,866,391 B2
(45) Date of Patent: Jan. 11, 2011

(54) SHOE FOR WELLBORE LINING TUBING

(75) Inventors: Michael Wardley, Aberdeenshire (GB); Paul Howlett, Aberdeen (GB)

(73) Assignee: Caledus Limited, Aberdeen (GB)

( * ) Notice: Subject to any disclaimer, the term of this patent is extended or adjusted under 35 U.S.C. 154(b) by 281 days.

(21) Appl. No.: 11/996,362

(22) PCT Filed: Jul. 24, 2006

(86) PCT No.: PCT/GB2006/002779

§ 371 (c)(1),
(2), (4) Date: Apr. 30, 2008

(87) PCT Pub. No.: WO2007/012842

PCT Pub. Date: Feb. 1, 2007

(65) Prior Publication Data

US 2008/0196903 A1 Aug. 21, 2008

(30) Foreign Application Priority Data

Jul. 23, 2005 (GB) ..... 0515204.6

(51) Int. Cl.
*E21B 33/14* (2006.01)

(52) U.S. Cl. ..... 166/285; 166/177.4; 166/242.8

(58) Field of Classification Search ..... 166/285, 166/177.4, 242.8
See application file for complete search history.

(56) References Cited

U.S. PATENT DOCUMENTS 4,469,174 A * 9/1984 Freeman ..... 166/202
6,223,823 B1 5/2001 Head
6,401,824 B1 * 6/2002 Musselwhite et al. ..... 166/327
2006/0011354 A1 * 1/2006 Logiudice et al. ..... 166/380

FOREIGN PATENT DOCUMENTS

WO 0169037 9/2001

* cited by examiner

*Primary Examiner*—William P Neuder
(74) *Attorney, Agent, or Firm*—Daniel N. Lundeen; Lundeen & Lundeen PLLC

(57) ABSTRACT

This invention relates to a shoe for wellbore lining tubing and to a method of locating wellbore lining tubing in a wellbore. In one embodiment, a shoe (30) is disclosed which includes a tubular outer body (32) that is coupled to a wellbore lining tubing (28), and a tubular inner body (36) located within the outer body and coupled to fluid supply tubing (38). A generally annular flow area (44) is defined between the bodies which is in selective fluid communication with the well-bore (10), for the return flow of fluid from the wellbore through a flow port (62) in the outer body, along the shoe and into an annulus (46) defined between the wellbore lining tubing and the fluid supply tubing. A valve assembly (40) of the shoe has an actuating member (92) located within the inner body, and a flow controller (96) for selectively closing the flow port. A ball (98) is used to prevent further fluid flow through the inner body into the wellbore. Exposure of the actuating member to fluid at a first fluid pressure then causes the actuating member to move to an actuating position where the flow controller closes the flow port. Exposure to fluid at a second fluid pressure higher than said first pressure reopens fluid flow from the inner body into the wellbore.

37 Claims, 4 Drawing Sheets

SHOE FOR WELLBORE LINING TUBING

CROSS REFERENCE TO RELATED APPLICATIONS

This application is a section 371 national stage application of PCT/GB2006/002779, filed Jul. 24, 2006, which claims the section 119 benefit of and priority to GB 0515204.6, Jul. 23, 2005.

The present invention relates to a shoe for wellbore lining tubing and to a method of locating wellbore lining tubing in a wellbore. In particular, but not exclusively, the present invention relates to a shoe for wellbore lining tubing having a valve assembly including at least one valve for preventing return flow of fluid from the wellbore into a fluid supply tubing coupled to the shoe.

In the oil and gas exploration and production industry, a wellbore or borehole is drilled from surface to gain access to subterranean hydrocarbon-bearing rock formations. The wellbore is typically drilled to a first depth, and wellbore lining tubing known as casing is located in the drilled wellbore and is cemented in place. The casing both supports the drilled rock formations and prevents undesired fluid ingress. The wellbore is then typically extended, and a smaller diameter casing is located within the extended section, passing through the first casing to surface. This is repeated as necessary to gain access to a producing formation. Often, a wellbore lining tubing known as a liner is coupled to and extends from the bottom of the lowermost casing section, to gain access to a producing formation.

Whilst this method has been employed for many years in the industry, there are disadvantages associated with lining a wellbore in this fashion. In particular, in the installation of smaller diameter casing sections within outer, larger diameter casings, it is necessary to pump fluid down through the smaller diameter casing and into the wellbore. This fluid flows up the extended wellbore, into the larger diameter casing and to surface, carrying residual solid debris present in the wellbore. Once the smaller diameter casing has been located at a desired position, the casing is cemented in place.

Relatively large radial spacings are required between concentric sections of smaller diameter casings in order to allow fluid flow along the casing sections during running and cementing. As a result, outer casing diameters are relatively large, causing significant material wastage, particularly as each casing section extends to surface. Furthermore, the process of drilling the relatively large diameter upper sections of the wellbore produces large volumes of drill cuttings, which must be stored for cleaning pending safe disposal. Also as each casing string is cemented in place, large volumes of cement are required.

In an effort to address these disadvantages, it has been proposed to seek to reduce the radial spacings between the casing sections. However, this has required development of alternative methods and tools for circulating fluid into the drilled wellbore. U.S. Pat. No. 6,223,823 (assigned to the present Applicant) discloses a method of installing a casing section in a well where a flow path is provided through an annular space between lowering means for lowering a casing section into an existing casing. Whilst the apparatus and method of U.S. Pat. No. 6,223,823 provides a significant step forward from conventional casing installation methods and apparatus, it is generally desired to improve upon the disclosed structure and method.

It is therefore amongst the objects of embodiments of the present invention to obviate or mitigate at least one of the foregoing disadvantages. In particular, in embodiments of the present invention, it is an object to provide an improved shoe for wellbore lining tubing and an improved method of locating wellbore lining tubing in a wellbore.

According to a first aspect of the present invention, there is provided a shoe for wellbore lining tubing, the shoe comprising:

a tubular outer body adapted to be coupled to a wellbore lining tubing;

a tubular inner body located within the outer body, the inner body adapted to be coupled to a fluid supply tubing located within the wellbore lining tubing, for the flow of fluid through the inner body into a wellbore;

a valve assembly comprising at least one valve for preventing flow of fluid from the wellbore through the inner body and into the fluid supply tubing; and a generally annular flow area defined between the inner and outer bodies, for the selective return flow of fluid from the wellbore along the shoe and into an annulus defined between the wellbore lining tubing and the fluid supply tubing, a radial width of the annular flow area varying in a direction around a circumference of the inner body.

In use, part of the fluid directed into the wellbore returns to surface up the outside of the shoe and the wellbore lining tubing. However, at least part of the fluid directed into the wellbore is diverted into the shoe annular flow area, and thus into the annulus defined between the wellbore lining tubing and the fluid supply tubing. The shoe may be a flow diversion shoe for diverting fluid flow from the wellbore into the annular flow area. Thus, whilst part of the fluid returns to surface along the outside of the shoe wellbore lining tubing, by diverting at least part of the return fluid flow into the shoe annular flow area, it is possible to reduce the radial spacing between concentric sections of wellbore lining tubing.

By providing a shoe comprising a generally annular flow area, where a radial width of the flow area varies in a direction around a circumference of the inner body, the flow of fluid from the wellbore along the shoe and into the annulus defined between the wellbore lining tubing and the fluid supply tubing is enhanced relative to prior apparatus. In this fashion, there is a reduced likelihood of the annular flow area becoming blocked, for example, by debris present in the wellbore.

The wellbore lining tubing may comprise a casing or a liner, and the shoe may therefore be a casing shoe or a liner shoe. However, it will be understood that the shoe may alternatively be for any other suitable downhole tubing.

The tubing outer body may be provided as part of or integral with the wellbore lining tubing.

The inner body is preferably located eccentrically within the outer body. A main axis of the inner body may therefore be off-centre, that is misaligned or non-coaxial with a main axis of the outer body. This may facilitate definition of the varying radial width of the annular flow area.

Preferably, the valve assembly further comprises an actuating member located within the inner body; and a flow controller for selectively permitting fluid flow from the wellbore into the flow area. The actuating member may be adapted to actuate the flow controller to move between open and closed positions, to control fluid flow into the flow area.

The tubular outer body may have at least one flow port for fluid communication between the wellbore and an interior of the outer body, to facilitate return flow of fluid from the wellbore into the annular flow area. The valve assembly may comprise a ball, and the actuating member may include a ball seat. In use, the ball may be adapted to be brought into abutment with the ball seat, to selectively prevent further fluid flow through the inner body into the wellbore. This may facilitate generation of a back-pressure behind the ball, for closing the flow port. In particular, exposure of the actuating member to fluid at a first fluid pressure may cause the actuating member to move to an actuating position, thereby moving the flow controller to close the flow port. This first fluid pressure may be greater than that which would be generated due to normal flow of fluids through the inner body into the wellbore, and thus it may be necessary to increase the fluid pressure in order to actuate the flow controller. The actuating member may be moveable to a further position on exposure to fluid at a second fluid pressure higher than said first pressure, whereupon fluid flow from the inner body into the wellbore is reopened.

It will be understood that when the flow port in the outer body is closed, and the actuating member has been moved to the further position such that fluid flow into the wellbore is reopened, all fluid flowing into the wellbore passes up an outer annulus defined between the wellbore (or a larger diameter outer wellbore lining tubing) and an outer surface of the shoe outer body/wellbore lining tubing. This may facilitate, for example, cementing of the wellbore lining tubing within the wellbore.

By providing a valve assembly where the flow controller is actuated to close the flow port on the actuating member feeling a first fluid pressure; and where fluid flow from the inner body into the wellbore is reopened on the actuating member feeling a second, higher fluid pressure, this provides an indication that the wellbore lining tubing has been correctly set in the wellbore, and that cementing may proceed. This is because two pressure variations or signals are detected; a first when the flow controller has been correctly actuated, and a second when the actuating member is moved to reopen flow to the wellbore. However if, for example, the fluid pressure is prematurely raised to a sufficient level that the actuating member is moved to the further position before the flow controller has been fully actuated, only a single fluid pressure variation will be detected at surface, indicating that the flow controller has not been correctly actuated.

The actuating member may be mounted for movement relative to the inner body, and may be mounted for movement within an inner bore of the inner body. The actuating member may be moveable between an initial position where the flow port is open and an actuating position where the flow port is closed.

The valve assembly may comprise a restraint for restraining the actuating member against movement relative to the inner body, in particular, for holding the actuating member in the initial position. The actuating member may be restrained against movement by a pin or a bolt, which may be adapted to shear at a first shear force exerted on the pin when the actuating member is exposed to fluid at the first fluid pressure.

The actuating member may be operatively associated with the flow controller such that movement of the actuating member moves the flow controller to close the flow port. The actuating member may be coupled to the flow controller by a pin, bolt or the like, which may be adapted to shear at a second shear force exerted on the pin, when the actuating member is exposed to fluid at the second fluid pressure. The flow controller pin may extend through a wall of the inner body for coupling the flow controller to the actuating member, and may be moveable within a slot or channel formed in the inner body wall. The actuating member may thus be restrained against movement beyond the actuating position by the pin bottoming out in the slot, until such time as sufficient force is exerted to shear the pin. In this fashion, incorrect setting of the flow controller may be detected at surface. This is because, in the event that the flow controller pin has not bottomed out in the slot, the pin shears at a lower fluid pressure exerted on the actuating member, as a bending moment is generated along the pin.

The flow controller may be located in the annular flow area, and may take the form of a flow diverter. The flow controller may be generally annular, and a radial width of the flow controller may vary around a circumference thereof, corresponding to the variation in radial width of the annular flow area. The flow controller may include at least one flow passage for permitting fluid flow from the wellbore (through the flow port) and into the annular flow area. The flow controller may comprise a channel extending around a circumference of the controller, and the flow passage may open on to the channel and extend along at least part of a length of the flow controller. This may provide for fluid flow from the wellbore (through the flow port) into the channel; from the channel into the flow passage; and from the flow passage into the flow area. The flow port may be adapted to be closed by moving the flow controller to a position where the flow port and the channel are misaligned.

The valve of the valve assembly may be initially held in an open position and may be isolated from exposure to flowing fluid. In this fashion, wear of the valve (due, for example, to abrasive particles present in fluid flowing through the inner body) is prevented until such time as it is desired to actuate the valve to close. The valve may take the form of a check valve and in preferred embodiments, the valve assembly comprises two such check valves, a primary check valve and a secondary check valve. The primary check valve may be initially isolated from flowing fluid, the secondary valve providing initial prevention of return fluid flow from the wellbore, until such time as the primary valve has been actuated. The primary and secondary check valves may be flapper valves or ball valves, and a spring or actuator for closing the primary valve may be adapted to exert a relatively greater force on the primary valve than a corresponding actuator of the secondary valve.

The shoe may comprise a one-way valve for selectively permitting fluid communication between the annular flow area and the interior of the inner body. This may prevent hydraulic lock during use of the shoe. In particular, the inner body may be adapted to be coupled to the fluid supply tubing via a connector such as a stinger, which may be located within and sealed relative to the inner body, or to an intermediate coupling sub or the like connected to the inner body. The one-way valve may thus facilitate removal of the stinger following closure of the valve of the valve assembly, preventing hydraulic lock.

The shoe may comprise a nose provided lowermost on the shoe and coupled to the inner and outer bodies, which nose may define a main flow port for flow of fluid from the inner body into the wellbore.

Preferably, the shoe comprises a diverter surface for diverting a drilling or milling bit run into the shoe to drill out the shoe, to subsequently open the wellbore lining tubing for further downhole procedures. The diverter or deflector surface may deflect the drill bit towards an inner wall of the inner body, to assist in causing the bit to grip the inner body.

According to a second aspect of the present invention, there is provided a method of locating wellbore lining tubing in a wellbore, the method comprising the steps of:

coupling a shoe to a wellbore lining tubing to be located in a wellbore;

running the wellbore lining tubing and the shoe into the wellbore;

directing fluid along a fluid supply tubing located within the wellbore lining tubing, through an inner body of the shoe coupled to the fluid supply tubing and into the wellbore;

preventing flow of fluid from the wellbore through the inner body and into the fluid supply tubing;

permitting return flow of fluid from the wellbore into a generally annular flow area defined between an outer body of the shoe and the inner body, which annular flow area varies in radial width in a direction around a circumference of the inner body; and directing returned fluid from the annular flow area into an annulus defined between the wellbore lining tubing and the fluid supply tubing.

According to a third aspect of the present invention, there is provided a shoe for wellbore lining tubing, the shoe comprising:

a tubular outer body adapted to be coupled to a wellbore lining tubing, the outer body having at least one flow port for fluid communication between the wellbore and an interior of the outer body;

a tubular inner body located within the outer body and adapted to be coupled to fluid supply tubing located within the wellbore lining tubing, for the flow of fluid through the inner body into the wellbore;

a generally annular flow area defined between the inner and outer bodies, the flow area in selective fluid communication with the wellbore through the flow port, for the return flow of fluid from the wellbore along the shoe and into an annulus defined between the wellbore lining tubing and the fluid supply tubing; and a valve assembly comprising an actuating member located within the inner body and defining a ball seat, a flow controller for selectively closing the flow port and a ball adapted to sealingly abut the valve seat;

wherein the ball is adapted to be brought into abutment with the valve seat to prevent further fluid flow through the inner body into the wellbore, and whereupon exposure of the actuating member to fluid at a first fluid pressure causes the actuating member to move to an actuating position thereby moving the flow controller to close the flow port; and wherein the actuating member is movable to a further position on exposure to fluid at a second fluid pressure higher than said first pressure, where fluid flow from the inner body into the wellbore is reopened.

According to a fourth aspect of the present invention, there is provided a method of locating wellbore lining tubing in a wellbore, the method comprising the steps of:

coupling a shoe to a wellbore lining tubing to be located in a wellbore;

running the wellbore lining tubing and the shoe into the wellbore;

directing fluid along a fluid supply tubing located within the wellbore lining tubing, through an inner body of the shoe coupled to the fluid supply tubing and into the wellbore;

permitting return flow of fluid from the wellbore into a generally annular flow area defined between an outer body of the shoe and the inner body through at least one flow port of the outer body;

landing a ball on a valve seat defined by an actuating member located within the inner body, to prevent further fluid flow through the inner body and into the wellbore;

exposing the actuating member to fluid at a first fluid pressure, to move the actuating member to an actuating position, to cause a flow controller of the valve assembly to close the flow port; and subsequently exposing the actuating member to fluid at a second fluid pressure higher than said first fluid pressure, to reopen fluid flow from the inner body into the wellbore.

According to a fifth aspect of the present invention, there is provided a shoe for wellbore lining tubing, the shoe comprising:

a tubular outer body adapted to be coupled to a wellbore lining tubing;

a tubular inner body located within the outer body and adapted to be coupled to a fluid supply tubing located within the wellbore lining tubing, for the flow of fluid through the inner body into the wellbore;

a generally annular flow area defined between the inner and outer bodies, for the return flow of fluid from the wellbore along the shoe and into an annulus defined between the wellbore lining tubing and the fluid supply tubing; and a valve assembly including a valve for selectively preventing return flow of fluid from the wellbore into the inner body, wherein the valve is initially in an open position and isolated from flowing fluid.

According to a sixth aspect of the present invention, there is provided a method of locating wellbore lining tubing in a wellbore, the method comprising the steps of:

coupling a shoe to a wellbore lining tubing to be located in a wellbore;

directing fluid along a fluid supply tubing located within the wellbore lining tubing, through an inner body of the shoe coupled to the fluid supply tubing and into the wellbore;

running the wellbore lining tubing and the shoe into the wellbore with a valve of a valve assembly of the shoe in an open position where the valve is isolated from flowing fluid;

permitting return flow of fluid from the wellbore into a generally annular flow area defined between an outer body of the shoe and the inner body; and subsequently actuating the valve assembly to expose the valve and to move the valve to a closed position, thereby preventing return flow of fluid from the wellbore into the inner body.

Further features of the third to sixth aspects of the invention in common with the first and second aspects are defined above. Furthermore, the features of one or more of the above aspects of the invention may be provided singularly or in combination.

According to a seventh aspect of the present invention, there is provided wellbore lining tubing comprising the shoe of any one of the first, third or fifth aspects of the invention.

Embodiments of the present invention will now be described, by way of example only, with reference to the accompanying drawings, in which.

Figure 1:
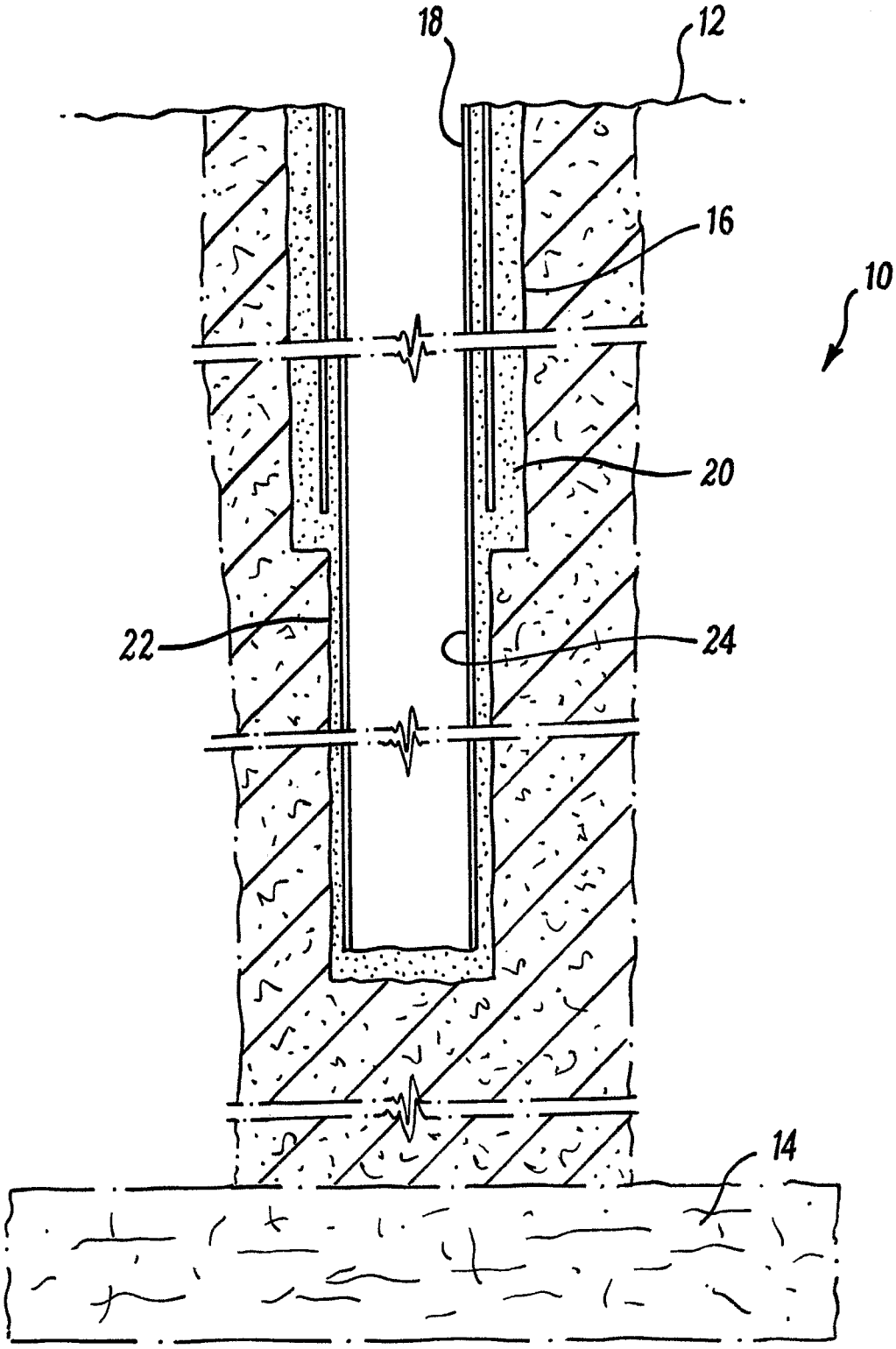
FIG. 1 is a longitudinal sectional view of a wellbore during drilling and lining with wellbore lining tubing.

Turning firstly to FIG. 1, there is shown a wellbore 10 during drilling and lining with wellbore lining tubing. As will be understood by persons skilled in the art, the wellbore 10 is drilled from surface 12 to gain access to a subterranean rock formation 14 containing well fluids including oil and/or gas. The wellbore 10 is shown in FIG. 1 following drilling of a first wellbore section 16 to a first depth, which has been lined with wellbore lining tubing in the form of a first casing section 18, and the casing section 18 has been cemented at 20, both to support the drilled rock formations, and to prevent undesired fluid ingress into the casing section 18. The wellbore 10 has then been extended to a second depth by drilling of a second, smaller diameter wellbore section 22, and a second, smaller diameter casing section 24 has been located within the first casing section 18, extending from the surface 12 through the first casing section 18. The second casing section 24 has then been cemented in place within the open wellbore section 22 and the first casing section 16, utilising the shoe of the present invention, which will be described.

Figure 2:
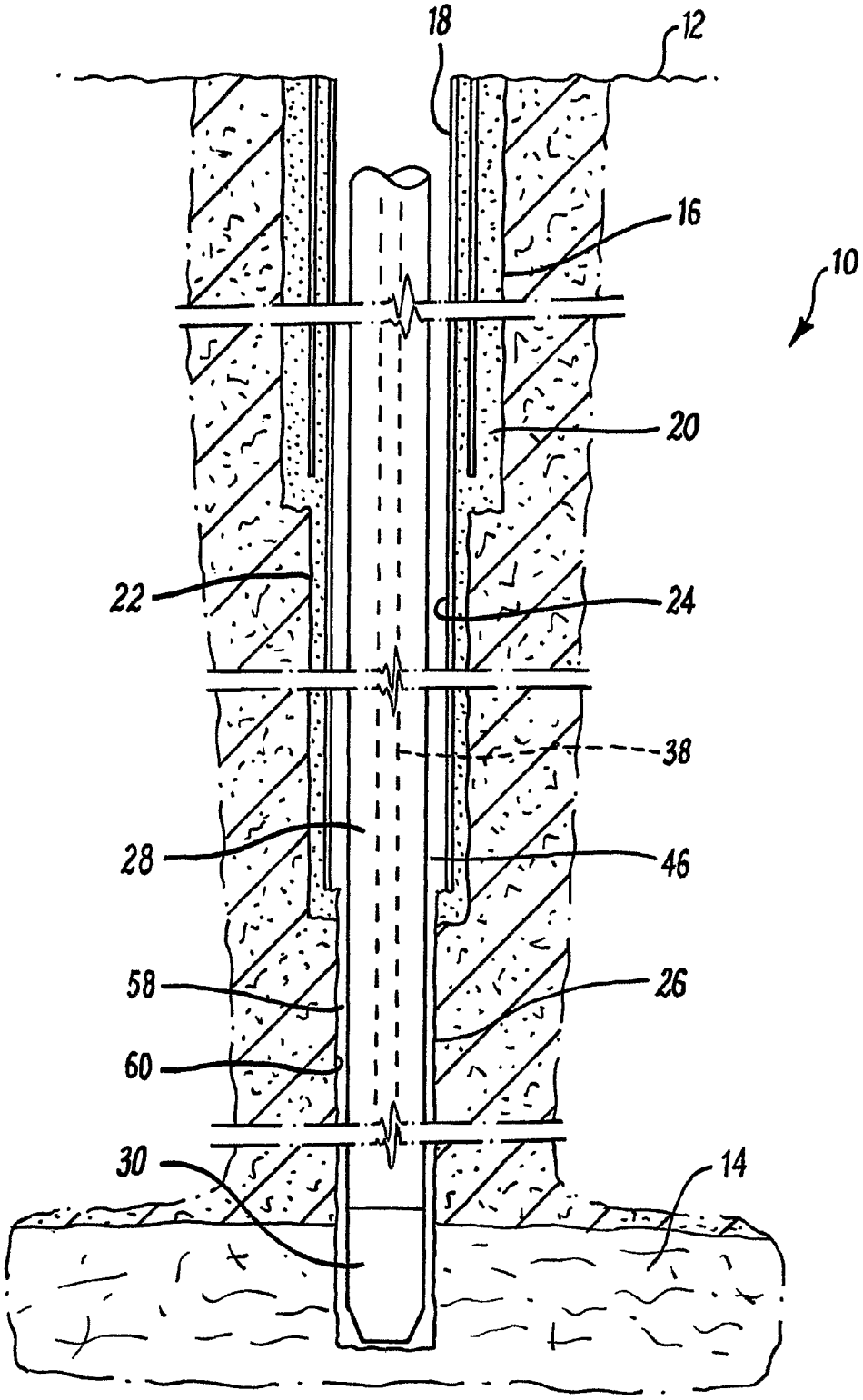
FIG. 2 is a view of the wellbore of FIG. 1 shown during installation of a section of wellbore lining tubing in an extended, open section of the wellbore, the wellbore lining tubing coupled to a shoe in accordance with a preferred embodiment of the present invention.

Turning therefore to FIG. 2, the wellbore 10 is shown following extension to a third depth by drilling of a third wellbore section 26 of smaller diameter than the second wellbore section 22, and is illustrated during installation of a third casing section 28 within the second casing section 22. A shoe 30 for wellbore lining tubing, in accordance with a preferred embodiment of the present invention, is coupled to the third casing section 28, and is utilised both to assist in running and cementing of the casing section 28. In particular and as will be described below, the shoe 30 facilitates minimisation of a radial spacing between each successive casing section located in the wellbore 10, offering advantages over conventional methods of lining a wellbore including reduction of material wastage and thus cost by use of smaller diameter casing sections; reduction of resultant volumes of drill cuttings with consequent cost savings in terms of drilling time, cleaning, storage and disposal of drill cuttings; and reductions in the volumes of cement required, with consequent storage and cost savings.

Figure 3:
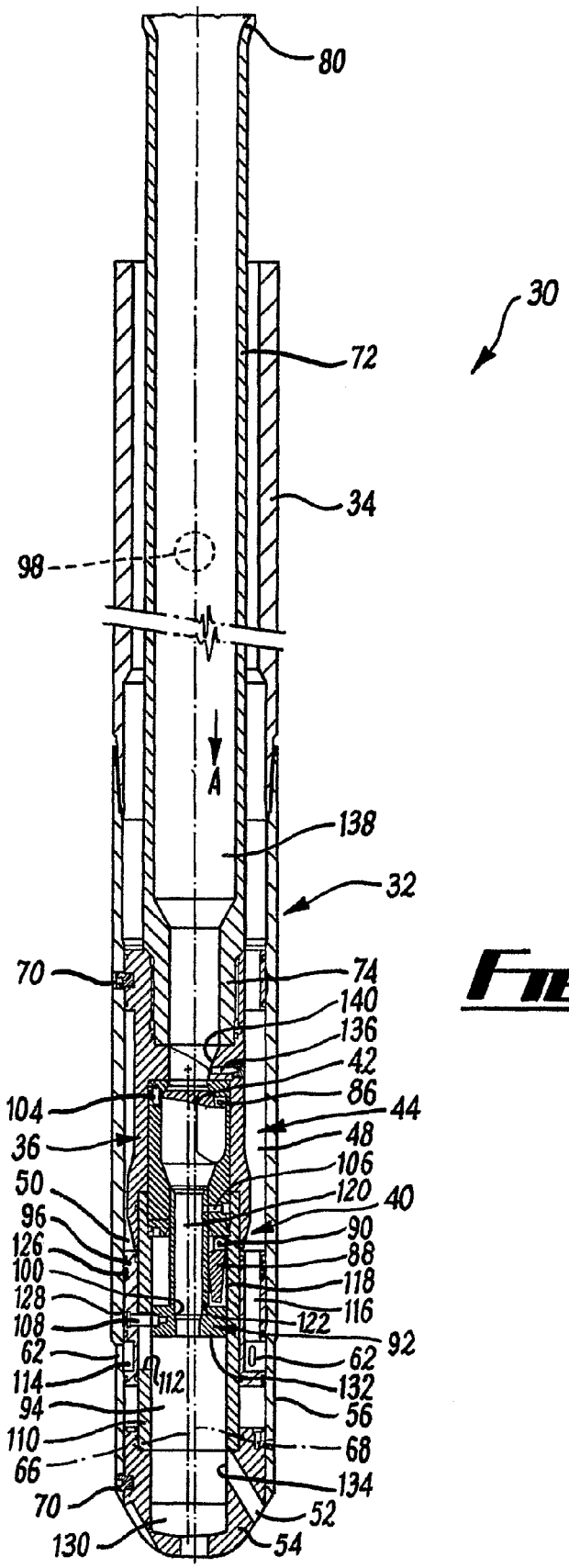
FIG. 3 is an enlarged, longitudinal sectional view of the shoe of FIG. 2.

The shoe 30 is also shown in the enlarged, half-sectional view of FIG. 3, separately from the wellbore 10, for ease of illustration. The shoe 30 takes the form of a flow-diverter shoe, and serves both for circulating fluid into the wellbore 10 during running and installation of the casing section 28, and for subsequently controlling the supply of cement into the wellbore 10, for sealing the casing 28 in the wellbore 10. The shoe 30 includes a tubular outer body 32 which is coupled to the casing 26 through an intermediate coupling sub 34, although it will be understood that the outer body 32 may alternatively be coupled directly to the casing 28. A tubular inner body 36 is located within the outer body 32, and is coupled to a fluid supply tubing 38 which is located within and extends through the casing 28, and which is shown in broken outline in FIG. 2. The fluid supply tubing 38 serves for the flow of fluid through the inner body 36 and into the wellbore 10 during running/cementing.

The shoe 30 also includes a valve assembly 40 comprising a valve 42 for preventing flow of fluid back from the wellbore 10 through the inner body 36 and into the fluid supply tubing 38. Also, a generally annular flow area 44 is defined between the inner and outer bodies 36, 32 and serves for the selective return flow of fluid from the wellbore 10 along the shoe 30, and into an annulus 46 (FIG. 2) defined between the casing 26 and the fluid supply tubing 38. A radial width of the annular flow area 44 varies in a direction around a circumference of the inner body 36, such that the flow area 44 has a maximum radial width in a region 48 and a minimum radial width in a region 50, which is spaced 180° around the circumference of the inner body 36. By varying the radial width of the flow area 44 in this fashion, the dimensions of the flow area in the region 48 are maximised, facilitating fluid flow along the flow area 44 and reducing or avoiding the likelihood of the flow area 44 becoming blocked, for example, by solid debris.

In general terms, the shoe 30 is utilised as follows. The shoe 30 is provided lowermost on the casing section 28 and is coupled to the casing at surface. The casing 28, carrying the shoe 30, is run-into the wellbore 10 through the larger diameter second casing 24, and into the open wellbore section 26. During run-in of the casing 28, fluid such as drilling fluid is circulated into the wellbore 10, to ease passage of the casing. The fluid is pumped down through the fluid supply tubing 38 and flows through the shoe 30 inner body 36, exiting into the open section 26 of the wellbore 10 through an inclined passage 52 provided in a nose 54 of the shoe 30. The shoe 30 is initially in the configuration shown in FIG. 3, and fluid flowing into the wellbore section 26 through the passage 52 flows upwardly along an external surface 56 of the outer body 32. Part of the fluid continues along a main, outer annulus 58 (FIG. 2) defined between the shoe 30/casing 28 and a wall 60 of the wellbore section 26, which continues into the existing, second casing section 24 and thus to surface.

However, the radial spacing between the second, larger casing 22 and the third casing section 28 is minimal, and a significant portion of the fluid is diverted and returns into the shoe 30. To facilitate this, the shoe outer body 32 includes at least one flow port 62 and, in the illustrated embodiment, includes a plurality of flow ports 62 spaced around a circumference of the outer body 32. In the FIG. 3 configuration of the shoe 30, the flow ports 62 are open and in fluid communication with the annular flow area 44, such that fluid entering the shoe 30 through the ports 62 flows into flow area 44, and thus along the shoe 30 into the annulus 46 defined between the fluid supply tubing 38 and the casing 28. It will therefore be understood that a significant portion of the fluid directed into the wellbore 10 returns to surface along the annulus 46, which facilitates minimisation of the radial gap between concentric casing sections. Furthermore, it will be understood that the fluid returning from the wellbore 10 into the shoe 30 carries entrained solid debris (such as drill cuttings, cement residue or the like present in the wellbore 10 following earlier downhole procedures). By providing a flow area 44 of varying radial width, with a maximum width in the region 48, the likelihood of blockage of the flow area 44 is reduced or avoided, ensuring correct subsequent operation of the shoe 30.

Once the shoe 30 has been located at the desired depth, and the casing section 28 thus positioned within the wellbore section 26, the shoe 30 is actuated to close the flow ports 62. This ensures that further fluid pumped into the wellbore 10 through the shoe 30 is directed up the main, outer annulus 58, and permits cementation of the casing 28 in place, without return flow of cement into the shoe through the flow ports 62. Following cementation, the shoe 30 is drilled out to open the casing section 28, permitting completion of the wellbore 10 to gain access to the producing formation 14, or extension of the wellbore 10, to permit location of a further, smaller diameter casing section (not shown) within the section 28 extending to surface, or a liner (not shown) extending from the base of the casing section 28 to a desired depth.

Figure 4:
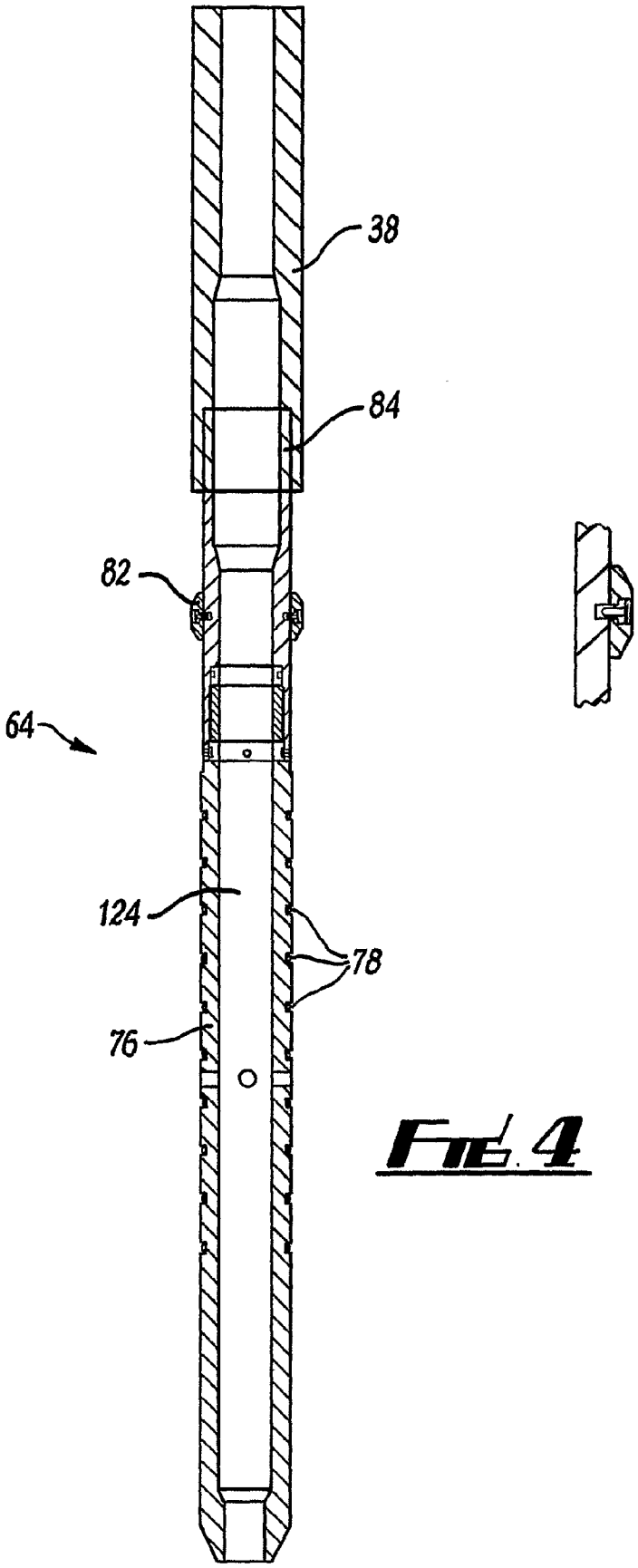
FIG. 4 is a longitudinal, half-sectional view of a stinger assembly utilised to couple the shoe of FIG. 2 to fluid supply tubing.

The structure and method of operation of the shoe 30 will now be described in more detail, with reference also to FIG. 4, which is a longitudinal, half-sectional view of a stinger assembly 64 utilised to couple the shoe to the fluid supply tubing 38.

The shoe inner body 36 is located eccentrically within the outer body 32, such that the main axis 66 of the inner body 36 is spaced (non-coaxial) from a main axis 68 of the outer body 32. As the inner and outer bodies 36, 32 are cylindrical tubulars, this eccentric location of the inner body 36 within the outer body 32 defines the shape of the annular flow area 44, wherein the radial width varies around a circumference of the inner body 36. The inner body 36 is coupled to and thus restrained relative to the outer body 32 by two fixing pins 70, and a receptacle 72, which is threaded at a lower end 74, is coupled to the inner body 36. The stinger assembly 64 includes a stinger 76 which is received within the receptacle 72, and the stinger 76 carries a number of O-rings or similar seals 78, which provide a seal between the stinger 76 and the receptacle 72. The receptacle 72 includes an upper flange 80 which defines a seat for abutting a shear ring 82 on the stinger 76, to prevent the stinger 76 from passing entirely into the receptacle 72. The stinger 76 is coupled at an upper end 84 to a lower section of the fluid supply tubing 38, and thus provides a sealed connection between the supply tubing 38 and the inner body 36. Providing the stinger 76 ensures that the fluid supply tubing 38 is sealed relative to the shoe inner body 36 irrespective of a relative axial position of the fluid supply tubing 38 within the casing section 28.

The valve 42 of the valve assembly 40 is provided below the receptacle 72, and takes the form of a flapper type check valve, which permits fluid flow through the inner body 36 in the direction of the arrow A, on exposure to a fluid pressure force sufficient to move the flapper valve 42 from the closed position shown, to an open position, against the action of a biasing spring 86. In addition, the valve assembly includes a further flapper type check valve 88 which, as will be described below, is initially held in an open position and is isolated from fluid flowing through the inner body 36. The flapper valve 88 in-fact forms a primary check valve 88, whilst the valve 42 forms a secondary check valve. Indeed, the check valve 88 is urged towards a closed position by a biasing spring 90, similar to that of the valve 42 shown in FIG. 3. However, the biasing spring 90 is rated higher than the spring 86, such that a greater closing force is exerted on the primary check valve 88, relative to the secondary check valve 42. As described above, the secondary check valve 42 prevents return flow of fluid from the wellbore 10 into the fluid supply tubing 38. Once the primary check valve 88 has been freed to move to a closed position, a more secure, double barrier is provided, to prevent such return flow of fluid.

The valve assembly 40 also includes an actuating member in the form of a tubular piston 92, which is mounted within an internal bore 94 of the inner body 36, and which is selectively moveable along a length of the bore. Additionally, the valve assembly includes a flow controller in the form of a generally annular piston-like flow controller piston 96, which is located within the annular flow area 44 and is selectively moveable relative to the inner and outer bodies 36, 32. Also, the valve assembly 40 includes a ball 98, which is landed on a ball seat 100 defined by the piston 92 to actuate the flow controller 96, as will be described.

The tubular piston 92 is coupled to an internal spacer 102, which is mounted in the inner body bore 94 and coupled to the inner body by a locating pin 104. The tubular piston 92 is secured to the internal spacer 102 by a shear pin 106, which initially restrains the tubular piston 92 against movement, to hold the piston in the position shown in FIG. 3. The actuating piston 92 is also coupled to the flow controller 96 through a shear pin 108, which extends through a wall 110 of the inner body 36, and which is moveable within an axial slot or channel 112 formed in the body wall 110. The flow controller 92 is thus initially held in the open position shown in FIG. 3, by virtue of the actuating piston 92 being held by the shear pin 106. In this position, the flow controller 96 permits fluid communication between the outer body flow ports 62 and the annular flow area 44.

In more detail, the flow controller 96 includes a circumferentially extending channel or recess 114 which, in the open position of the flow controller, is axially aligned with the flow ports 62. An axial flow passage 116 extends along part of a length of the flow controller in a region of the flow controller of greatest radial width, and opens at one end on to the channel 114, and at the other end onto the annular flow area 44 above the flow controller 96. It will be understood that a number of such passages 116 may be provided.

In the initial, closed position of the actuating piston 92 shown in FIG. 3, the primary check valve 88 is isolated from flowing fluid, to reduce wear of the check valve 88 until it is actuated to a closed position. It will be understood that the check valve is isolated in that it is held in a position where there is no fluid impinging on the valve, but there is fluid communication between a space 118 in which the check valve 88 is located (when in the closed position) and an inner bore 120 of the actuating piston 92, via a small communication port 122. This prevents hydraulic lock of the actuating piston 92.

The valve assembly 40 is actuated to close the flow ports 62, and thus to close the fluid flow path between the wellbore 10 and the annular flow area 44, as follows. The flow controller 96 is initially in the open position shown in FIG. 3. The ball 98 is pumped down through the fluid supply tubing 98, through an internal bore 124 of the stinger 76 and thus into and along the receptacle 72. The ball 98 then flows through the secondary check valve 42 (which is urged open by the force of fluid flowing through the inner body 36), and lands on the ball seat 100. With the ball 98 landed on the ball seat 100, further fluid flow through the inner body 36 is restricted or prevented, causing an increase in back-pressure behind the ball 98. This causes a fluid pressure force to be exerted on the actuating piston 92, which is initially restrained against movement by the shear pin 106, as described above. The fluid pressure is then increased above a typical operating pressure, and when the fluid pressure reaches a first threshold level, the first shear pin 106 shears, releasing the actuating piston 92 for movement relative to the inner body 36. The actuating piston 92 is thus urged axially downwardly, carrying the flow controller 96 by virtue of the connection between the piston and the flow controller through the second shear pin 108. As the second shear pin 108 is rated higher than the first shear pin 106, the second pin initially remains intact. Translation of the actuating piston 92 carries the flow controller 96 axially downwardly, misaligning the channel 114 relative to the flow ports 62, thereby closing the flow ports. The flow controller 96 carries a split ring, circlip 126 or the like which lands out in a recess 128 formed in the outer body 32, to restrain the flow controller 96 in the closed position.

The actuating piston 92 has thus been moved from the initial position shown in FIG. 3, to an actuating position, where the second shear pin 108 has bottomed-out on a base of the axial channel 112, thereby restraining the actuating piston 92 against further movement beyond the actuating position. With the actuating piston 92 in this position, further fluid flow into the wellbore through the inclined passage 52 is prevented. When it is desired to reopen fluid flow into the wellbore 10 through the passage 52, the fluid pressure is increased beyond the first level to a second threshold pressure, at which a sufficiently large pressure force is felt by the actuating piston 92 to shear the second shear pin 108. This frees the actuating piston 92 to move beyond the actuating position to a further position, where the piston resides in a base 130 of the shoe 30, which is defined by the nose 54. In this further position, a piston head 132 of the actuating piston 92 has moved axially beyond an inlet 134 of the passage 52, thereby reopening fluid communication with the wellbore 10. The actuating piston 92 has now moved clear of the primary check valve 88, which is urged to the closed position by the spring 90, providing a double barrier to return flow of fluid into the fluid supply tubing 38.

Following such movement of the actuating piston 92 into the shoe base 130, and movement of the flow controller 96 to close the flow ports 62, further fluid flow into the wellbore 10 is directed up the outside of the shoe 30, along the main outer annulus 58, permitting cementation of the casing section 28. The stinger assembly 64 may then be pulled, and the stinger 76 retracted from the receptacle 72. To facilitate this movement, the shoe 30 includes a one-way valve 136 which permits fluid communication between the flow area 44 and an interior bore 138 of the receptacle 72, thereby preventing hydraulic lock. The shoe 30 may then be drilled out to open the casing section 28, by passing a drilling or milling tool (not shown) down into the shoe 30. To facilitate drilling out of the shoe 30, the shoe includes a deflecting or diverting surface 140, which deflects the drill bit radially outwardly, to assist the bit in gripping the inner body 36 to drill out the shoe. Following drilling out of the shoe 30, further downhole procedures may be carried out. For example, a completion string may be landed and completion procedures carried out to gain access to production fluids from the formation 14. Alternatively, the wellbore 10 may be extended to a further depth and the procedure described above repeated for locating a further smaller diameter casing section (not shown) within the cemented casing 28. In a further alternative, a liner may be located in such an extension, tied into the bottom of the casing section 28.

To recap, the casing section 28 is therefore run and located as follows. During run-in of the casing section 28, fluid such as drilling fluid is pumped down through the fluid supply tubing 38, out of the shoe 30 through the passage 52 and into the wellbore 10. Part of the fluid returns to surface along the main, outer annulus 58, but a significant part of the fluid flows into the annular flow area 44 through the flow ports 62 and thus to surface, carrying entrained debris. During run-in, return flow of fluid from the wellbore 10 into the fluid supply tubing 38 prevented by the secondary check valve 42.

When the casing section 28 has been located in the desired position within the wellbore section 26, the ball 98 is pumped down through the fluid supply tubing 38 into the shoe 30, and lands on the ball seat 100. This prevents further flow of fluid into the wellbore 10 through the shoe 30. The fluid pressure is then increased above the first threshold level, and the shear pin 106 breaks, allowing the actuating piston 92 to move downwardly, carrying the flow controller 96 and closing the flow ports 62. This closes off fluid communication between the wellbore 10 and the annular flow area 44. The actuating piston 92 is then moved to the further position, to reopen fluid flow into the wellbore 10, by increasing fluid pressure above the section threshold level, breaking the second shear pin 108. Cement is then pumped down through the shoe 30 and into the wellbore 10 through the passage 52, to cement and seal the casing 28 in position. Return of cement from the wellbore 10 into the fluid supply tubing 38 is prevented by the double barrier of the primary and secondary check valves 38, 42.

Provision of the two shear pins 106, 108 where the second pin 108 is rated higher than the first pin 106 provides a double pressure signal at surface, thereby indicating correct setting of the flow controller 96. For example, if only a first pressure signal is detected at surface, where a reduction in pressure occurs due to shearing of the two pins 106, 108 simultaneously, this indicates that the connection between the actuating piston 92 and the flow control 96 has been sheared prematurely, and that the flow controller 62 is unlikely to have been moved to the closed position. Accordingly, the flow ports 62 would remain open and the casing 28 could not be cemented. The casing 28 would then require to be brought to surface and the shoe 30 reset for redeployment. Furthermore, in the event that the second shear pin 108 is not bottomed-out in the axial channel 112, indicating that the flow controller 96 has not moved to the closed position, the shear pin 108 would shear at a lower applied fluid pressure. This is because a bending moment would be exerted along the shear pin 108, causing it to shear prematurely. This similarly provides an indication of incorrect setting of the flow controller 96.

Various modifications may be made to the foregoing without departing from the spirit and scope of the present invention. For example, the shoe may be suitable for use with other types of downhole tubing where fluid is directed through the tubing into the wellbore, or casing/liner in the wellbore, in use.

The invention claimed is:

1. A shoe for wellbore lining tubing, the shoe comprising:

a tubular outer body adapted to be coupled to a wellbore lining tubing, the outer body having at least one flow port for fluid communication between the wellbore and an interior of the outer body;

a tubular inner body located within the outer body and adapted to be coupled to fluid supply tubing located within the wellbore lining tubing, for the flow of fluid through the inner body into the wellbore;

a generally annular flow area defined between the inner and outer bodies, the flow area in selective fluid communication with the wellbore through the flow port, for the return flow of fluid from the wellbore along the shoe and into an annulus defined between the wellbore lining tubing and the fluid supply tubing; and a valve assembly comprising an actuating member located within the inner body and defining a ball seat, a flow controller for selectively closing the flow port and a ball adapted to sealingly abut the valve seat;

wherein the ball is adapted to be brought into abutment with the valve seat to prevent further fluid flow through the inner body into the wellbore, and whereupon exposure of the actuating member to fluid at a first fluid pressure causes the actuating member to move to an actuating position thereby moving the flow controller to close the flow port; and wherein the actuating member is movable to a further position on exposure to fluid at a second fluid pressure higher than said first pressure, where fluid flow from the inner body into the wellbore is reopened.

2. A shoe as claimed in claim 1, wherein a radial width of the annular flow area varies in a direction around a circumference of the inner body.

3. A shoe as claimed in claim 1, wherein in use, at least part of the fluid directed into the wellbore is subsequently diverted into the shoe annular flow area, and thus into the annulus defined between the wellbore lining tubing and the fluid supply tubing.

4. A shoe as claimed in claim 1, wherein the inner body is located eccentrically within the outer body.

5. A shoe as claimed in claim 1, wherein when the actuating member is in the further position, all fluid flowing into the wellbore passes up an outer annulus defined between the wellbore and an outer surface of the shoe outer body.

6. A shoe as claimed in claim 1, wherein in the initial position of the actuating member the flow port is open, and in the actuating position of the actuating member the flow port is closed.

7. A shoe as claimed in claim 1, wherein the valve assembly comprises a restraint for restraining the actuating member against movement relative to the inner body, and wherein the restraint holds the actuating member in the initial position.

8. A shoe as claimed in claim 7, wherein the restraint is adapted to shear at a first shear force exerted on the pin when the actuating member is exposed to fluid at the first fluid pressure.

9. A shoe as claimed in claim 1, wherein the flow controller is located in the annular flow area, is generally annular and has a radial width which varies around a circumference thereof corresponding to the variation in radial width of the annular flow area.

10. A shoe as claimed in claim 1, wherein the flow controller includes at least one flow passage for permitting fluid flow from the wellbore through the flow port and into the annular flow area.

11. A shoe as claimed in claim 10, wherein the flow controller comprises a channel extending around a circumference of the controller, and wherein the flow passage opens on to the channel and extends along at least part of a length of the flow controller.

12. A shoe as claimed in claim 11, wherein the flow port is adapted to be closed by moving the flow controller to a position where the flow port and the channel are misaligned.

13. A shoe as claimed in claim 1, wherein the valve assembly comprises at least one valve for preventing flow of fluid from the wellbore through the inner body and into the fluid supply tubing, and wherein the at least one valve is initially held in an open position isolated from exposure to flowing fluid.

14. A shoe as claimed in claim 13, wherein the valve assembly comprises a primary check valve and a secondary check valve, the primary check valve initially isolated from flowing fluid, the secondary check valve providing initial prevention of return fluid flow from the wellbore, until such time as the primary check valve has been actuated.

15. A shoe as claimed in claim 14, comprising actuators for closing the primary and secondary check valves, wherein the actuator for closing the primary check valve is adapted to exert a relatively greater force on the primary check valve than the corresponding actuator of the secondary check valve.

16. Wellbore lining tubing comprising the shoe of claim 1.

17. A method of locating wellbore lining tubing in a wellbore, the method comprising the steps of:

coupling a shoe to a wellbore lining tubing to be located in a wellbore;

running the wellbore lining tubing and the shoe into the wellbore;

directing fluid along a fluid supply tubing located within the wellbore lining tubing, through an inner body of the shoe coupled to the fluid supply tubing and into the wellbore;

permitting return flow of fluid from the wellbore into a generally annular flow area defined between an outer body of the shoe and the inner body through at least one flow port of the outer body;

landing a ball on a valve seat defined by an actuating member located within the inner body, to prevent further fluid flow through the inner body and into the wellbore;

exposing the actuating member to fluid at a first fluid pressure, to move the actuating member to an actuating position, to cause a flow controller of the valve assembly to close the flow port; and subsequently exposing the actuating member to fluid at a second fluid pressure higher than said first fluid pressure, to reopen fluid flow from the inner body into the wellbore.

18. A shoe for wellbore lining tubing, the shoe comprising:

a tubular outer body adapted to be coupled to a wellbore lining tubing;

a tubular inner body located within the outer body, the inner body adapted to be coupled to a fluid supply tubing located within the wellbore lining tubing, for the flow of fluid through the inner body into a wellbore;

a valve assembly comprising at least one valve for preventing flow of fluid from the wellbore through the inner body and into the fluid supply tubing; and a generally annular flow area defined between the inner and outer bodies, for the selective return flow of fluid from the wellbore along the shoe and into an annulus defined between the wellbore lining tubing and the fluid supply tubing, a radial width of the annular flow area varying in a direction around a circumference of the inner body.

19. A shoe as claimed in claim 18 wherein, in use, part of the fluid directed into the wellbore returns to surface up the outside of the shoe and the wellbore lining tubing.

20. A shoe as claimed in claim 18, wherein at least part of the fluid directed into the wellbore is diverted into the shoe annular flow area, and thus into the annulus defined between the wellbore lining tubing and the fluid supply tubing.

21. A shoe as claimed in claim 18, wherein the tubing outer body is provided as part the wellbore lining tubing.

22. A shoe as claimed in claim 18, wherein the valve assembly further comprises an actuating member located within the inner body; and a flow controller for selectively permitting fluid flow from the wellbore into the flow area.

23. A shoe as claimed in claim 22, wherein the actuating member is adapted to actuate the flow controller to move between open and closed positions, to control fluid flow into the flow area.

24. A shoe as claimed in claim 22, wherein the valve assembly comprises a ball and the actuating member includes a ball seat, and wherein, in use, the ball is adapted to be brought into abutment with the ball seat, to selectively prevent further fluid flow through the inner body into the wellbore.

25. A shoe as claimed in claim 22, wherein the valve assembly comprises a first pin for restraining the actuating member against movement relative to the inner body, wherein the pin is adapted to shear at a first shear force exerted on the pin when the actuating member is exposed to fluid at the first fluid pressure.

26. A shoe as claimed in claim 22, wherein the actuating member is coupled to the flow controller by a second pin which is adapted to shear at a second shear force exerted on the pin, when the actuating member is exposed to fluid at the second fluid pressure.

27. A shoe as claimed in claim 22, wherein the flow controller includes at least one flow passage for permitting fluid flow from the wellbore and into the annular flow area.

28. A shoe as claimed in claim 27, wherein the flow controller comprises a channel extending around a circumference of the controller, the flow passage opening on to the channel and extending along at least part of a length of the flow controller.

29. A shoe as claimed in claim 18, comprising a one-way valve for selectively permitting fluid communication between the annular flow area and the interior of the inner body, to prevent hydraulic lock during use of the shoe.

30. A shoe as claimed in claim 29, wherein the inner body is adapted to be coupled to the fluid supply tubing via a connector which is located within and sealed relative to the inner body.

31. A shoe as claimed in claim 18, comprising a diverter surface for diverting a drilling bit run into the shoe to drill out the shoe, to subsequently open the wellbore lining tubing for further downhole procedures.

32. A shoe as claimed in claim 31, wherein the diverter surface is adapted to deflect the drill bit towards an inner wall of the inner body, to assist in causing the bit to grip the inner body.

33. Wellbore lining tubing comprising the shoe of claim 18.

34. A method of locating wellbore lining tubing in a wellbore, the method comprising the steps of:

coupling a shoe to a wellbore lining tubing to be located in a wellbore;

running the wellbore lining tubing and the shoe into the wellbore;

directing fluid along a fluid supply tubing located within the wellbore lining tubing, through an inner body of the shoe coupled to the fluid supply tubing and into the wellbore;

preventing flow of fluid from the wellbore through the inner body and into the fluid supply tubing;

permitting return flow of fluid from the wellbore into a generally annular flow area defined between an outer body of the shoe and the inner body, which annular flow area varies in radial width in a direction around a circumference of the inner body; and directing returned fluid from the annular flow area into an annulus defined between the wellbore lining tubing and the fluid supply tubing.

35. A shoe for wellbore lining tubing, the shoe comprising:

a tubular outer body adapted to be coupled to a wellbore lining tubing;

a tubular inner body located within the outer body and adapted to be coupled to a fluid supply tubing located within the wellbore lining tubing, for the flow of fluid through the inner body into the wellbore;

a generally annular flow area defined between the inner and outer bodies, for the return flow of fluid from the wellbore along the shoe and into an annulus defined between the wellbore lining tubing and the fluid supply tubing; and a valve assembly including a valve for selectively preventing return flow of fluid from the wellbore into the inner body, wherein the valve is initially in an open position and isolated from flowing fluid.

36. Wellbore lining tubing comprising the shoe of claim 35.

37. A method of locating wellbore lining tubing in a wellbore, the method comprising the steps of:

coupling a shoe to a wellbore lining tubing to be located in a wellbore;

directing fluid along a fluid supply tubing located within the wellbore lining tubing, through an inner body of the shoe coupled to the fluid supply tubing and into the wellbore;

running the wellbore lining tubing and the shoe into the wellbore with a valve of a valve assembly of the shoe in an open position where the valve is isolated from flowing fluid;

permitting return flow of fluid from the wellbore into a generally annular flow area defined between an outer body of the shoe and the inner body; and subsequently actuating the valve assembly to expose the valve and to move the valve to a closed position, thereby preventing return flow of fluid from the wellbore into the inner body.

* * * * *